US006231304B1

(12) United States Patent
Andersson

(10) Patent No.: US 6,231,304 B1
(45) Date of Patent: May 15, 2001

(54) OUTLET DEVICE FOR A FLOW MACHINE

(75) Inventor: Karl-Erik Andersson, Finspång (SE)

(73) Assignee: ABB Stal AB, Finspang (SE)

( * ) Notice: Subject to any disclaimer, the term of this patent is extended or adjusted under 35 U.S.C. 154(b) by 0 days.

(21) Appl. No.: 09/445,018

(22) PCT Filed: May 22, 1998

(86) PCT No.: PCT/SE98/00971

§ 371 Date: Feb. 17, 2000

§ 102(e) Date: Feb. 17, 2000

(87) PCT Pub. No.: WO98/55739

PCT Pub. Date: Dec. 10, 1998

(30) Foreign Application Priority Data

Jun. 5, 1997 (SE) ..... 9702148-9

(51) Int. Cl.[7] ..... F01D 25/30
(52) U.S. Cl. ..... 415/211.2
(58) Field of Search ..... 415/207, 208.2, 415/211.2, 216.1, 218.1

(56) References Cited

U.S. PATENT DOCUMENTS

| | | | | |
|---|---|---|---|---|
| 3,149,470 | | 9/1964 | Herzog | 60/697 |
| 4,214,452 | | 7/1980 | Riollet et al. . | |
| 5,188,510 | | 2/1993 | Norris et al. . | |
| 5,203,674 | | 4/1993 | Vinciguerra . | |
| 5,518,366 | * | 5/1996 | Gray | 415/226 |
| 5,707,208 | * | 1/1998 | Kreitmeier | 415/211.2 |

FOREIGN PATENT DOCUMENTS

| | | | | |
|---|---|---|---|---|
| 0 345 700 | | 6/1989 | (EP) . | |
| 1 105 245 | | 6/1955 | (FR) . | |
| 1-178706 | * | 7/1989 | (JP) | 415/211.2 |
| 86087 | * | 8/1957 | (NL) | 415/211.2 |

* cited by examiner

*Primary Examiner*—John E. Ryznic
(74) *Attorney, Agent, or Firm*—Connolly, Bove, Lodge & Hutz, LLP.

(57) ABSTRACT

An outlet device for a flow machine, comprising a channel for a flow from the machine and a guide vane arrangement provided downstream of the channel and connecting the channel with an outlet housing. The guide vane arrangement is arranged to redirect outwardly a first part flow of the flow from the channel into the first chamber of the outlet housing. The outlet device comprises at least one bypass channel extending from the channel through the guide vane arrangement and arranged to guide a second part flow of the flow to bypass the guide vane arrangement to a second chamber of the outlet housing.

14 Claims, 5 Drawing Sheets

OUTLET DEVICE FOR A FLOW MACHINE

TECHNICAL FIELD OF THE INVENTION AND PRIOR ART

The present invention relates to an outlet device for a flow machine according to the preamble of claim 1.

The invention will now be described in relation to a gas turbine. However, it is to be noted that the invention also is applicable to other types of flow machines, such as pumps, compressors, etc.

Usually, gas turbines comprise a diffuser arranged downstream of the turbine and shaped as a channel having an annular crosssection with an increasing cross-sectional area in the flow direction. The object of the diffuser is to decrease the velocity of the flow from the turbine and transform such a great part as possible of the kinetic energy of the flow to useful pressure energy. Downstream of the diffuser, there is a so called outlet housing, the object of which is to collect the flow from the diffuser to an outlet passage arranged to guide the flow from the turbine, often essentially perpendicularly in relation to the rotational axis of the turbine. In order to guide the flow from the diffuser into the outlet housing, it is known to let the diffuser terminate in an annular guide vane arrangement guiding the flow outwardly in a radial direction from the diffuser. In order to make it possible to collect and redirect the outwardly directed flow in the outlet housing without any appreciable losses of pressure, the outlet housing has to have a certain dimension, i.e. the radius at least in a lateral direction will be essentially larger than the radius of the diffuser and the turbine. A great lateral radius, i.e. a width, of the outlet housing means that the gas turbine plant requires a lot of space.

U.S. Pat. No. 5,188,510 shows an outlet device for a gas turbine, comprising an expanding diffuser channel for a flow from the gas turbine and an outlet housing provided downstream of the channel of the diffuser and guiding the flow outwardly in a direction essentially perpendicular to the rotational axis of the gas turbine. The outlet housing comprises an outlet baffle and a guide vane extending in the circumferential direction, which contribute to divide the flow into a plurality of different part flows through the outlet housing in order to enable an adaptation of the shape of the outlet housing to different kinetic energies of the different part flows.

SUMMARY OF THE INVENTION

The object of the present invention is to remedy the above mentioned problems and provide an outlet device which has an outlet housing with a reduced radius, at least in one direction, while maintaining the performance thereof.

This object is achieved by the outlet device initially defined and characterised in that the guide vane arrangement is arranged to redirect outwardly a first part flow of the flow from the channel into a first chamber of the outlet housing, and that the outlet device comprises at least one bypass channel, extending from the channel through said guide vane arrangement and arranged to guide a second part flow of said flow to bypass said guide vane arrangement to a second chamber of the outlet housing. By such an bypass channel extending through the guide vane arrangement, the radius or the width of the outlet housing may be decreased in the area where the bypass channel extends, because no flow will be directed outwardly in this area but continue rearwardly into the second chamber of the outlet housing. By the rearward direction is meant the direction towards the outlet of the flow machine and by the forward direction is meant the direction towards the inlet of the flow machine.

According to an embodiment of the invention, the first chamber and the second chamber are connected by a common outlet passage for said first and second part flows. In such a way, both the part flows may be reconnected to a common outlet flow.

According to a further embodiment of the invention, said bypass channel comprises at least one guide vane, arranged to direct at least a part of said second part flow through the second chamber to the outlet passage. In such a way, a desired flow direction may be obtained in the second chamber. Furthermore, the first chamber and the second chamber may be arranged to guide said first and second part flows, respectively, into the outlet passage in such a way that the flow directions of said part flows are essentially parallel through the outlet passage. Thereby, it is possible to provide a commonly outlet flow which is essentially clear of vortexes.

According to a further embodiment of the invention, said bypass channel extends essentially straight through the guide vane arrangement. By such a bypass channel the radial extension of the bypass channel may be reduced to a minimum. Nevertheless, the housing may have such a shape that the flow from its upper half may pass upwardly without being throttled.

According to a further embodiment of the invention, the outlet device comprises a rear wall member of the channel, wherein the guide vane arrangement is provided on the side of the wall member which faces the channel and a second chamber is provided on the side which faces away from the channel. Consequently, it is possible to increase the length of the outlet device as compensation for the decreased width. Thereby, the bypass channel extends through the rear wall member.

According to a further embodiment of the invention, the channel seen in a cross-section has an essentially annular shape. Advantageously, the outlet device may comprise two bypass channels which, seen in a section through the channels, are provided essentially diametrically in relation to each other. Such a symmetrical construction of the outlet device is preferable from a viewpoint of the flow.

According to a further embodiment of the invention, the guide vane arrangement is arranged to redirect outwardly said first part flow and at least partly forwardly in at least one first area of the extension of the guide vane arrangement in a circumferential direction. By guiding the flow forwardly in such a way, the formation of vortexes in the first chamber of the outlet housing may be essentially decreased. In certain applications, it may be advantageous to let the guide vane arrangement be arranged to redirect outwardly said first part flow in a second area of the extension of the guide vane arrangement in the circumferential direction. Thereby, the second area may be located on the side of the channel, which faces the outlet passage, and the first area on the side of the channel, which faces away from the outlet passage.

According to a further embodiment of the invention, the channel comprises support members, extending radially outwardly in the channel and an essentially plane plate is provided essentially in parallel to an axial plane upstream or downstream of each of the support members. By such a plate, the flowing of the flow through the channel may be guided in an essentially axial direction through the channel.

BRIEF DESCRIPTION OF THE DRAWINGS

The present invention is now to be explained more closely by means of different embodiments shown by way of example and with reference to the attached drawings.

DETAILED DESCRIPTION OF DIFFERENT EMBODIMENTS

Figure 1:
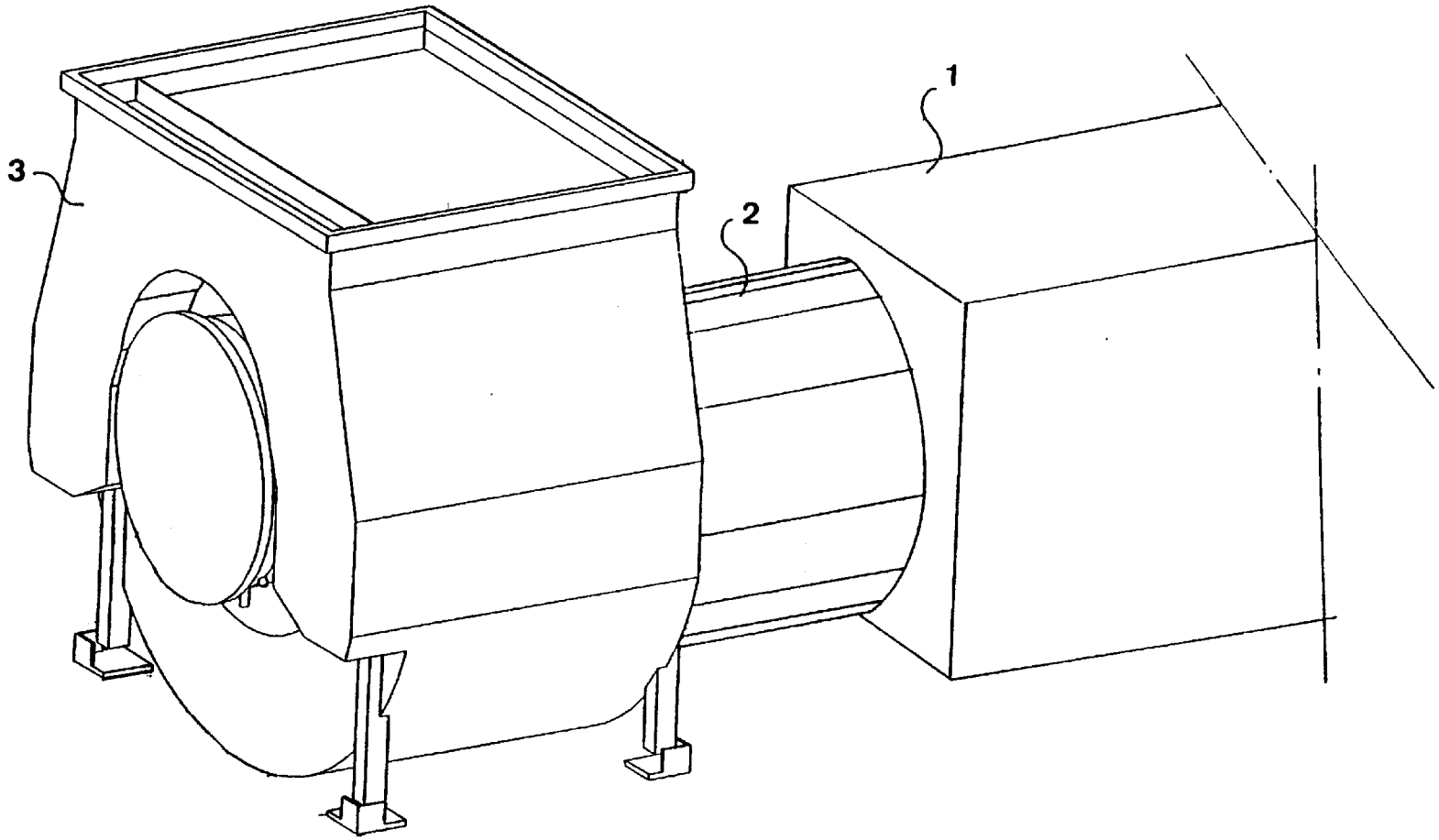
FIG. 1 shows a perspective view of a gas turbine with an outlet device according to the invention.
Figure 2:
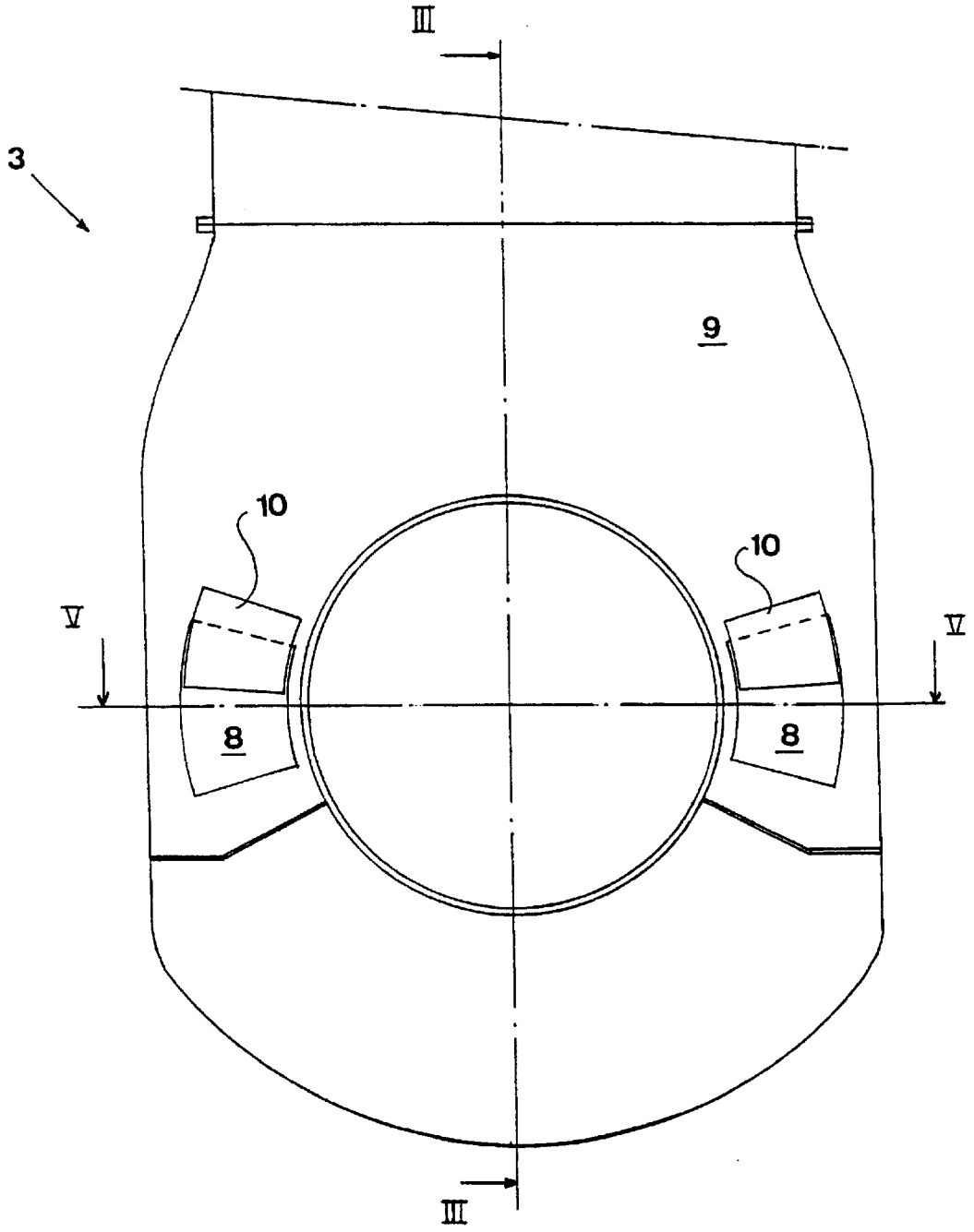
FIG. 2 shows a sectional view of the outlet device from behind according to an embodiment of the invention along the line II—II in FIG. 3.

FIG. 1 shows schematically a flow machine in the form of a gas turbine 1 and a gas channel 2 extending from the gas turbine 1 and arranged to guide the gas from the gas turbine 1 to an outlet device 3 according to present invention.

The outlet device 3 is now to be explained more closely by reference to FIGS. 2–6. The outlet device 3 comprises a channel 4 in the form of a diffuser channel with expanding cross-sectional area, see especially FIG. 3. The inlet end of the diffuser channel 4 (to the left in FIG. 3) is arranged to be connected to the gas channel 2. A guide vane arrangement 5 is provided downstream of the diffuser channel 4, which is arranged to redirect a first part flow of the flow through the diffuser channel 4 into an outlet housing 6 and in particular into a first chamber 7 of the outlet housing 6. Furthermore, the outlet device 3 comprises two essentially straight bypass channels 8, which each extends from the diffuser channel 4 through the guide vane arrangement 5 to a second chamber of the outlet housing 6, and which each is limited by a channel wall which encloses the bypass channel 4. Consequently, the bypass channels 8 are arranged to guide a second part flow of the flow through the diffuser channel 4 bypass the guide arrangement 5 and into the second chamber 9 in the main flow direction a of the flow through the diffuser channel 4. Furthermore, each of the bypass channels 8 comprises two guide vanes 10 arranged to guide at least a part of the second part flow, which flows out of the essentially straight bypass channel 4, upwardly through the second chamber 9, see especially FIG. 6. These guide vanes 10 have a favourable influence on the flow in the second chamber 9 and may contribute to a flow essentially clear of vortexes and directed upwardly through the second chamber 9. The first chamber 7 and the second chamber 9 are separated from each other by means of a rear wall member 11. The guide vane arrangement 5 is provided on the side of the wall member, which faces the diffuser channel 4, and the second chamber 9 is provided on the side of the wall member 11 which faces away from the diffuser channel 4. The first chamber 7 and the second chamber 9 are connected to each other above the wall member 11 in a common outlet passage 12 for the first part flow and the second part flow, which consequently are reconnected in the outlet passage 12, see especially FIG. 3.

Figure 5:
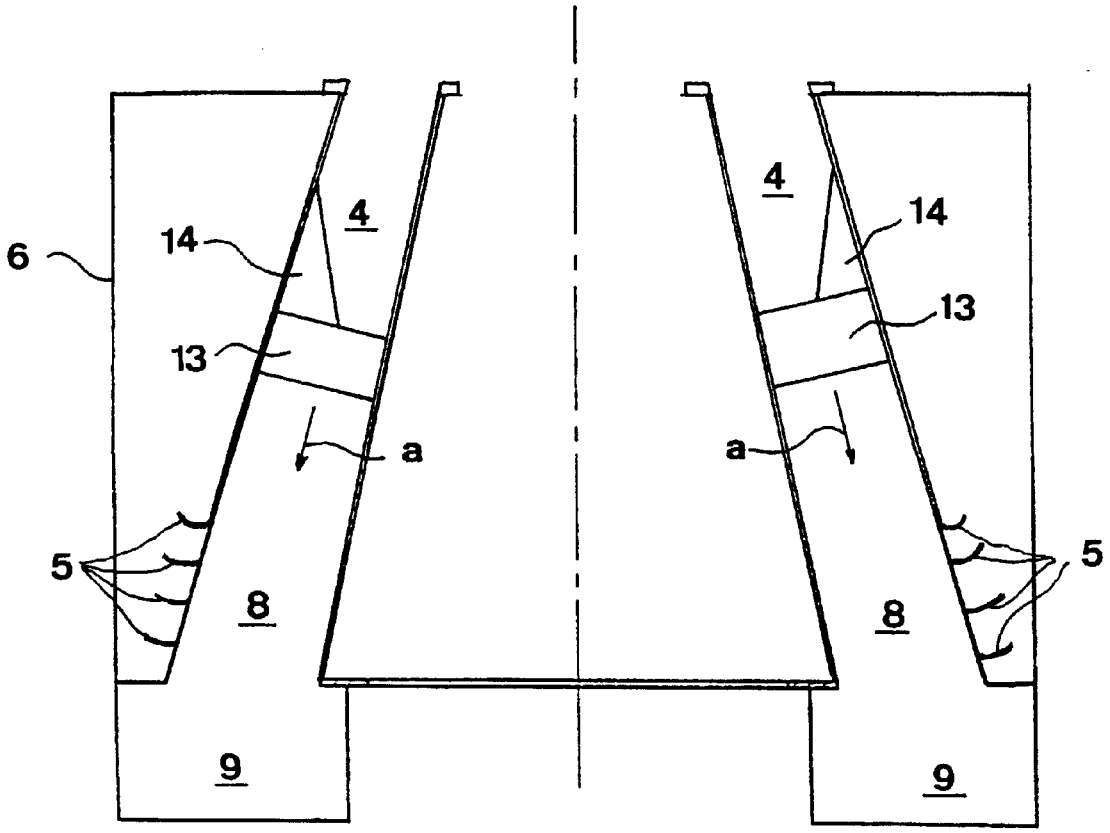
FIG. 5 shows a sectional view of the outlet device along the line V—V in FIG. 2.
Figure 6:
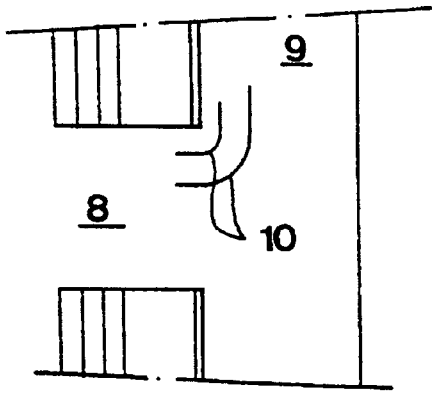
FIG. 6 shows a sectional view along the line VI—VI in FIG. 4.

As appears from FIGS. 5 and 6, the bypass channels 8 extend through the rear wall member 11. As appears from especially FIGS. 2 and 4, the bypass channels 8 are provided symmetrically and essentially diametrically in relation to each other seen in a radial section through the bypass channels 8.

Figure 3:
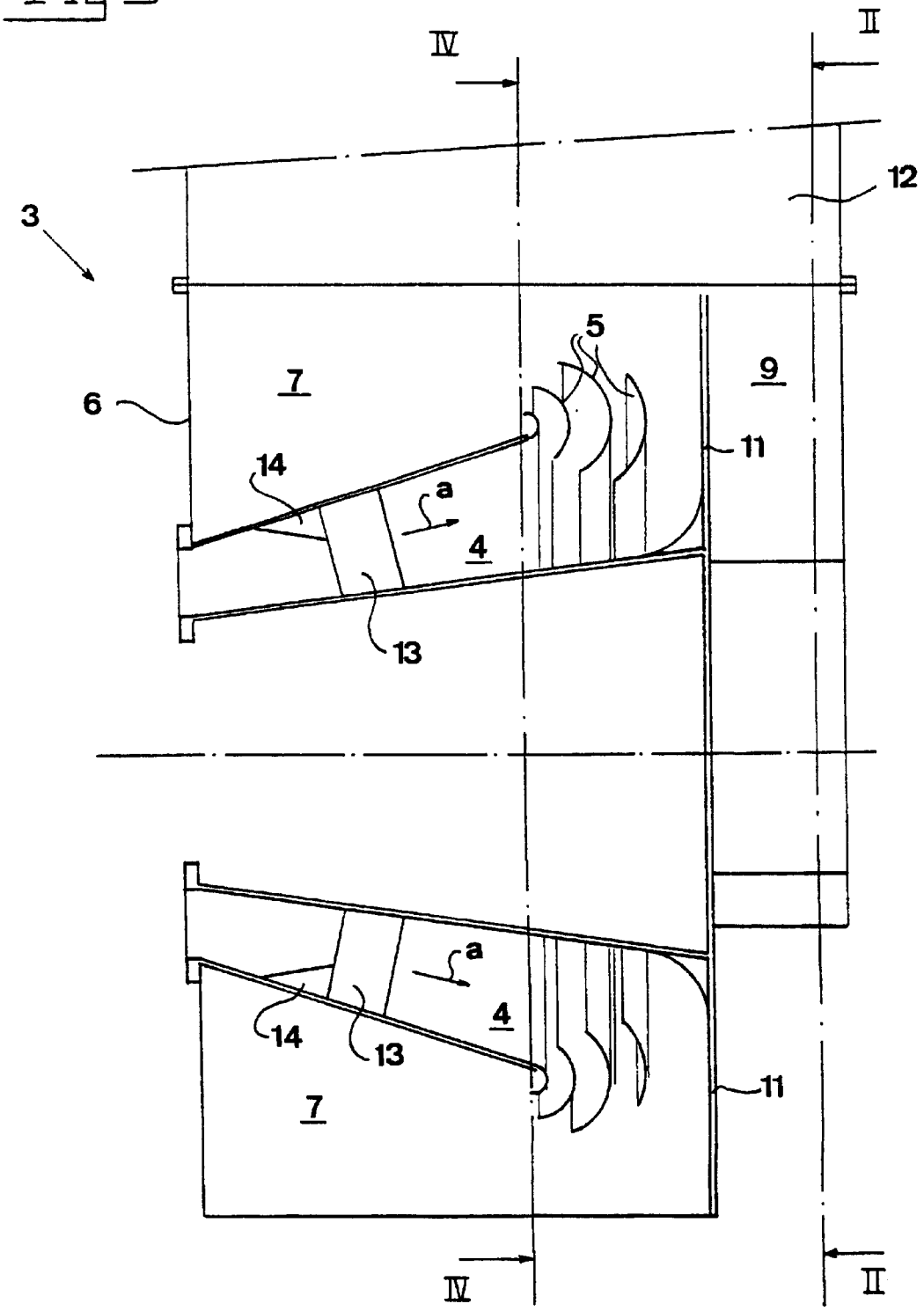
FIG. 3 shows a sectional view of the outlet device along the line III—IIII in FIG. 2.
Figure 4:
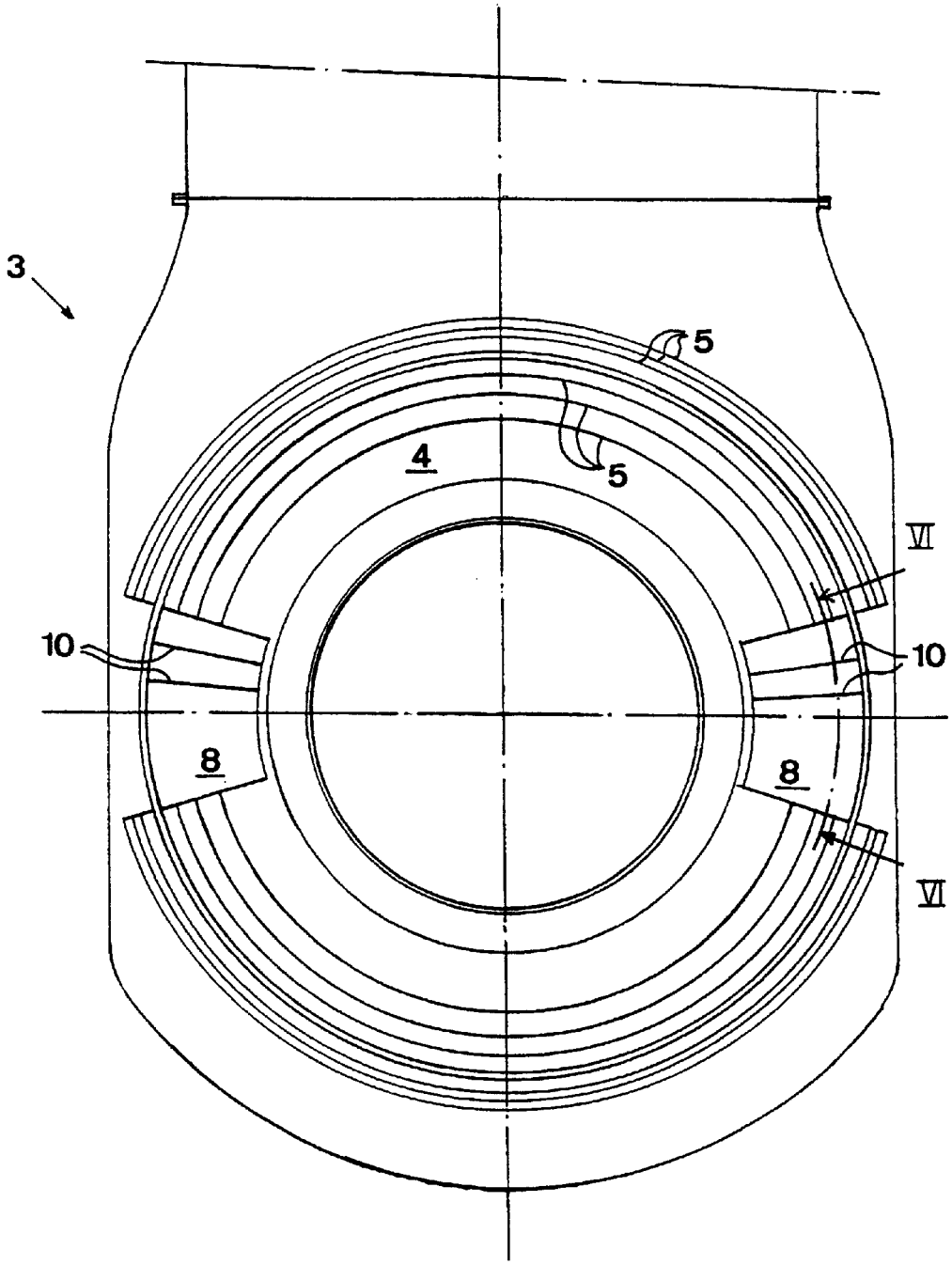
FIG. 4 shows a sectional view along the line IV—IV in FIG. 3.

As appears from FIG. 3, the guide vane arrangement 5 is arranged to redirect the first part flow from the diffuser channel 4 outwardly and at least partly forwardly, i.e. in a direction essentially opposite to the main flow direction a of the flow in the diffuser channel 4 or in other words essentially 180°. Consequently, the guide vane arrangement 5, shown in FIGS. 2–6, is symmetrical, i. e. it has the same shape around the whole circumference, of course with the exception of the bypass channels 8. It is also possible to design the guide vane arrangement 5, in an area, namely the upper part of the guide vane arrangement 5 located on the side of the diffuser channel 4 which faces the outlet passage 12, in such a way that the first part flow is directed essentially radially, i.e. straight towards the outlet passage 12.

As appears from FIGS. 3 and 5, support members 13 are provided in the diffuser channel 4 and extend essentially radially outwardly in the diffuser channel 4. The number of support members 13 in the diffuser channel 4 may vary, from two to nine, for example five. In front of, i.e. upstream of, each of the support members 13 an essentially plane plate 14 is provided essentially in parallel to an axial plane. In the embodiment shown, the plane plate 14 has an essentially triangular shape seen in an axial section through the plate 14. It is to be noted that it is also possible to provide the plane plates 14 downstream of the support members 13, especially if the support members 13 are located very close to the inlet of the diffuser channel 14.

The present invention is not restricted to the above described embodiments but may be varied and modified within the scope of the following claims. The invention is applicable to a number of different types of flow machines and not only to gas turbines, for example compressors, pumps and the like. In these cases, the channel 4 does not need to be designed as a diffuser channel with a cross-sectional area increasing in the flow direction but may have another shape. It is to be noted that the outlet device may comprise only one bypass channel 8 or possibly more than two such channels in the scope of the present invention. The bypass channels 8 may also comprise fewer or more than the two guide vanes 10 shown.

The present invention is applicable with respect to axial diffusers, radial diffusers as well as a combination thereof. In the case with radial diffusers, the rear wall member 11 may then be constituted of the rear wall of the radial diffuser.

What is claimed is:

1. An outlet device for a flow machine (1), comprising a channel (4) for a flow from said machine (1) and a guide vane arrangement (5) provided downstream of the channel (4) and connecting the channel (4) with an outlet housing (6), characterised in that the guide vane arrangement (5) is arranged to redirect outwardly a first part flow of the flow from the channel (4) into a first chamber (7) of the outlet housing (6), and that the outlet device (3) comprises at least one bypass channel (8), extending from the channel (4) through said guide vane arrangement (5) and arranged to guide a second part flow of said flow to bypass said guide vane arrangement (5) to a second chamber (9) of the outlet house (6).

2. An outlet device according to claim 1, characterised in that the first chamber (7) and the second chamber (9) are connected by a common outlet passage (12) for said first and second part flows.

3. An outlet device according to claim 2, characterised in that said by pass channel (8) comprises at least one guide vane (10), arranged to direct at least a part of said second part flow through the second chamber (9) to the outlet passage (12).

4. An outlet device according to claim 2, characterised in that the first chamber (7) and the second chamber (9) are arranged to guide said first and second part flows, respectively, into the outlet passage (12) in such a way that the flow directions of said part flows are essentially parallel through the outlet passage (12).

5. An outlet device according to claim 1, characterised in that said bypass channel (8) extends essentially straight through the guide vane arrangement (5).

6. An outlet device according to claim 1, characterised by a rear wall member (11) of the channel (4), wherein the guide vane arrangement (5) is provided on the side of the wall member which faces the channel (4) and the second chamber (9) is provided on the side which faces away from the channel (4).

7. An outlet device according to claims 1, characterised in that said bypass channel (8) extends through the rear wall member (11).

8. An outlet device according to claim 1, characterised in that the channel (4) seen in a cross- section has an essentially annular shape.

9. An outlet device according to claim 1, characterised in that it comprises two bypass channels (8) which, seen in a section through the channel (4), are provided essentially diametrically in relation to each other.

10. An outlet device according to claims 1, characterised in that the guide vane arrangement (5) is arranged to redirect outwardly said first part flow and at least partly forwardly in at least one first area of the extension of the guide vane arrangement in a circumferential direction.

11. An outlet device according claim 10, characterised in that the guide vane arrangement (5) is arranged to redirect outwardly said first part flow in a second area of the extension of the guide vane arrangement in the circumferential direction.

12. An outlet device according claim 11, characterised in that the second area is located on the side of the channel (4), which faces the outlet passage (12), and the first area on the side of the channel (4), which faces away from the outlet passage (12).

13. An outlet device according to claim 1, characterised in that the channel (4) comprises support members (13), extending radially outwardly in the channel (4) and an essentially plane plate (14) is provided essentially in parallel to an axial plane upstream or downstream of each of the support members (13).

14. An outlet device according to claim 1, characterised in that the channel (4) has an increasing cross-sectional area in the flow direction.

* * * * *